US006116952A

United States Patent [19]

Nakata

[11] Patent Number: 6,116,952

[45] Date of Patent: Sep. 12, 2000

[54] MULTIPOLE WATERPROOF CONNECTOR

[75] Inventor: Naohisa Nakata, Tokyo, Japan

[73] Assignee: Hirose Electric Co., Ltd., Tokyo, Japan

[21] Appl. No.: 09/421,408

[22] Filed: Oct. 21, 1999

[51] Int. Cl.[7] ..... H01R 13/40

[52] U.S. Cl. ..... 439/587; 439/404; 439/391

[58] Field of Search ..... 439/391, 393, 439/587, 404, 405, 406

[56] References Cited

U.S. PATENT DOCUMENTS

| | | | |
|---|---|---|---|
| 5,490,785 | 2/1996 | Hein et al. | 439/76.1 |
| 5,551,892 | 9/1996 | Endo et al. | 439/587 |
| 5,632,653 | 5/1997 | Sawada | 439/587 |
| 5,720,629 | 2/1998 | Self, Jr. et al. | 439/587 |
| 5,871,373 | 2/1999 | Pacini et al. | 439/587 |
| 5,931,699 | 8/1999 | Saito | 439/587 |
| 5,954,541 | 9/1999 | Ozai et al. | 439/608 |
| 6,039,596 | 3/2000 | Whiteman, Jr. et al. | 439/404 |

*Primary Examiner*—Paula Bradley
*Assistant Examiner*—Truc Nguyen
*Attorney, Agent, or Firm*—Kanesaka & Takeuchi

[57] ABSTRACT

A multipole waterproof connector comprises a connector body (1) consisting of a connector housing (7) and a plurality of press-fit terminals (8) attached to the connector housing, a press-fit or insulation-displacement block (2) consisting of an organizing protector (4), a multihole wire seal (5), and a retainer (6), a plurality of cables (3) put through the cable insertion apertures (30, 24, 18) of the retainer, the wire seal, and the organizing protector and bent at an end (3*a*) into the lateral cable insertion slots (22A, 22B), wherein the press-fit block is fitted into the connector body such that the press-fit or insulation-displacement portions of the press-fit or insulation-displacement terminals are press-fitted to the cables for connection by insulation displacement.

5 Claims, 10 Drawing Sheets

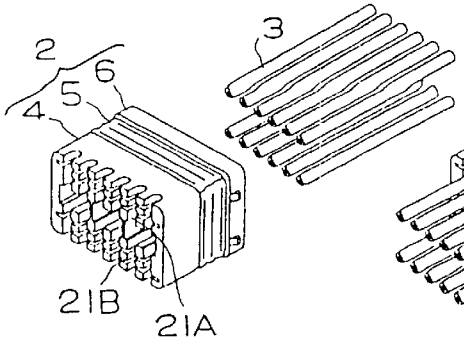
FIG. 2(1)
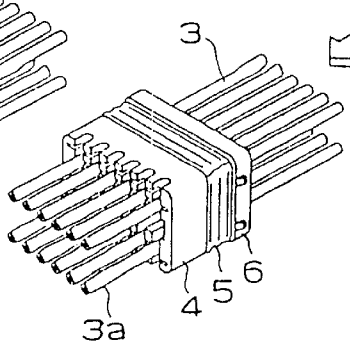
FIG. 2(2)
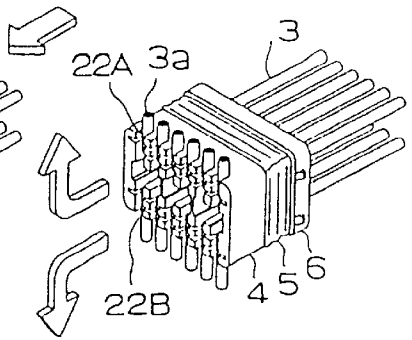
FIG. 2(3)
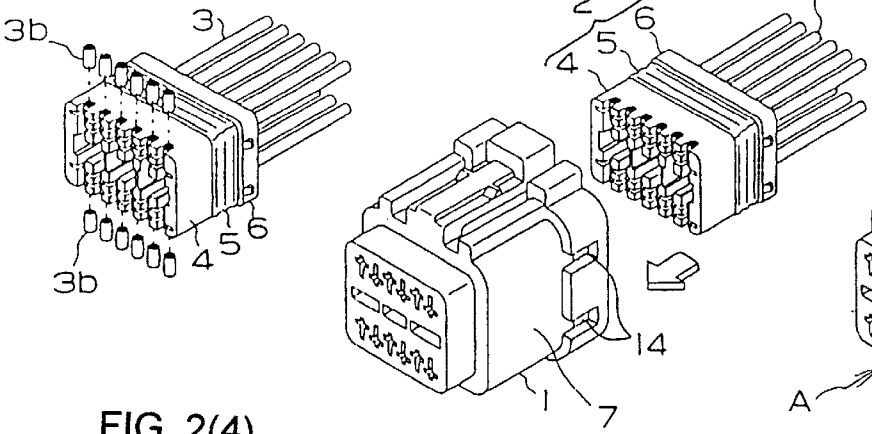
FIG. 2(4)
FIG. 2(5)
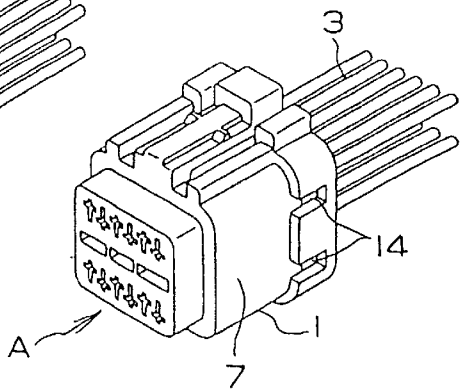
FIG. 2(6)

MULTIPOLE WATERPROOF CONNECTOR

BACKGROUND OF THE INVENTION

1. Field of the Invention

The present invention relates to multipole waterproof connectors to which a plurality of cables are connected.

2. Description of the Related Art

FIG. 18 shows a conventional cable 71 for a multipole waterproof connector. A contact terminal 70 is attached to an end of the cable 71. A wire seal 72 is attached to the cable 71. A large number of the cables 71 are mounted manually on a connector housing (not shown) at the contact terminals 70. A detecting member (not shown) is attached to the connector housing to detect poor insertion of the contact terminal 70.

However, the conventional multipole waterproof connector requires large amounts of labor in manual connection of the cables 71. The outside diameter of the wire seal 72 has an influence on the pitch-to-pitch dimension, and the resultant connector is larger than the open type connector.

SUMMARY OF THE INVENTION

Accordingly, it is an object of the invention to provide a compact multipole waterproof connector enabling not only an en-bloc but also automatic connection of cables.

According to one aspect of the invention there is provided a multipole waterproof connector comprising a connector housing having a plugging projection and a fitting recess; at least one press-fit (insulation-displacement) terminal attached to the connector housing such that a contact point and a press-fit (insulation-displacement) portion of the press-fit (insulation-displacement) terminal are on sides of the plugging projection and the fitting recess, respectively; a insertion-block having a wire seal around at least one cable insertion aperture; at least one cable put through the cable insertion aperture and bent at an end into the insertion-block; and the press-fit block being fitted into the connector housing such that the press-fit portion of the press-fit terminal is press-fitted to the cable.

After at least one cable is attached to the insertion-block, the press-fit block is fitted into the connector housing such that the press-fit portion of the press-fit terminal is press-fitted to the cable to make a compact multipole waterproof connector, thus making possible not only en-bloc connection but also automatic connection of the cable, reducing a considerable amount of labor.

According to another aspect of the invention there is provided a multipole waterproof connector comprising a connector housing having a plugging projection and a fitting recess; at least one press-fit (insulation-displacement) terminal such that a contact point and a press-fit (insulation-displacement) portion of the press-fit terminal are on sides of the plugging projection and the fitting recess, respectively; a insertion-block consisting of an organizing protector having at least one cable insertion slot, a wire seal, and retainer provided in this order such that cable insertion apertures of the organizing protector, the wire seal, and the retainer communicate with each other; at least one cable put through the cable insertion apertures and bent at one end into the cable insertion slot of the organizing protector; the insertion-block being fit into the connector housing such that the press-fit portion of the press-fit terminal is press-fitted to the cable.

After at least one cable is attached to the insertion-block, the press-fit block is fitted into the connector housing such that the press-fit portion of the press-fit terminal is press-fitted to the cable to make a compact multipole waterproof connector, making possible not only en-bloc connection but also automated connection of the cable, reducing a considerable amount of labor.

According still another aspect of the invention, the retainer has at least one spacer and the wire seal has at least one spacer fitting hole, and the organizing protector has a spacer fitting recess such that an end of the spacer is fitted in the spacer fitting recess through the spacer fitting hole.

Such a structure as just described above facilitates assembling of the insertion-block and connection of the cable.

According to yet another aspect of the invention there is provided a multipole waterproof connector the wire seal has at least one lip portion at a side wall, at least one lip portion around the cable insertion aperture, and at least one lip portion around the spacer fitting hole such that when the wire seal is held between the organizing protector and the retainer, the lip portions are pressed against an inside wall of the connector housing, the cable, and the spacer, respectively.

In such a structure as just described above, the lip portions on the side of the wire seal and around the cable insertion aperture and the spacer insertion hole are pressed against the inside wall of the connector housing, the cable, and the spacer, respectively, thus improving waterproof.

According to another aspect of the invention the connector housing has at least one projection provided on a bottom of the fitting recess and the organizing protector has at least one recess through which the cable insertion aperture extends, at least one longitudinal cable insertion slot on a side of the recess and at least lateral cable insertion slot on the organizing protector communicating with the longitudinal cable insertion slot such that the cable in the cable insertion aperture is inserted into the longitudinal cable insertion slot and bent into the lateral cable insertion slot and, when the insertion-block is fitted into the connector housing, the projection enters the recess to hold said.

In such a structure as just described above, the cable is inserted into the longitudinal cable insertion slot and then bent into the lateral cable insertion slot and, when the insertion-block is fitted into the connector housing, the projection enters the recess to hold the cable in the recess so that the pulling resistance of the cable is enhanced.

BRIEF DESCRIPTION OF THE DRAWINGS

FIGS. 2(1)–(6) are perspective views illustrating how cables are connected to the multipole waterproof connector;

FIG. 10(2) is a rear elevational view of the organizing protector;

DESCRIPTION OF THE PREFERRED EMBODIMENTS

Figure 1:
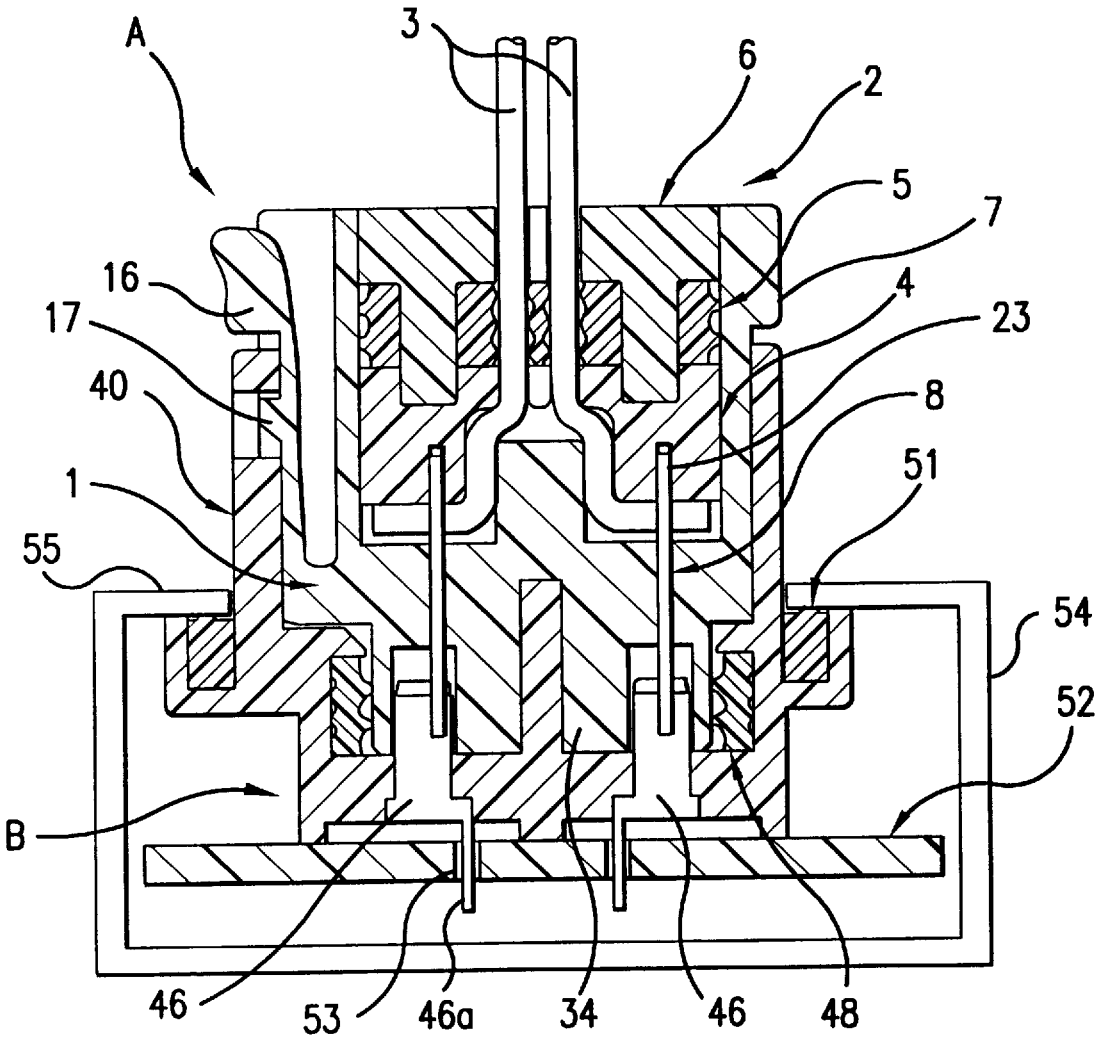
FIG. 1 is a longitudinal section of a multipole waterproof connector according to an embodiment of the invention.

In FIGS. 1 and 2(1)–(6), the multipole waterproof connector consists of a plug connector A and a receptacle connector B. The plug connector A comprises a connector body 1, a insertion-block 2, a large number of cables (wires) 3. The connector body 1 comprises a connector housing 7 and a plurality of press-fit (insulation-displacement) terminals 8 attached to the connector housing 7. The press-fit block 2 comprises a organizing protector 4, a multihole wire seal 5, and a retainer 6 for preventing bending.

Figure 3:
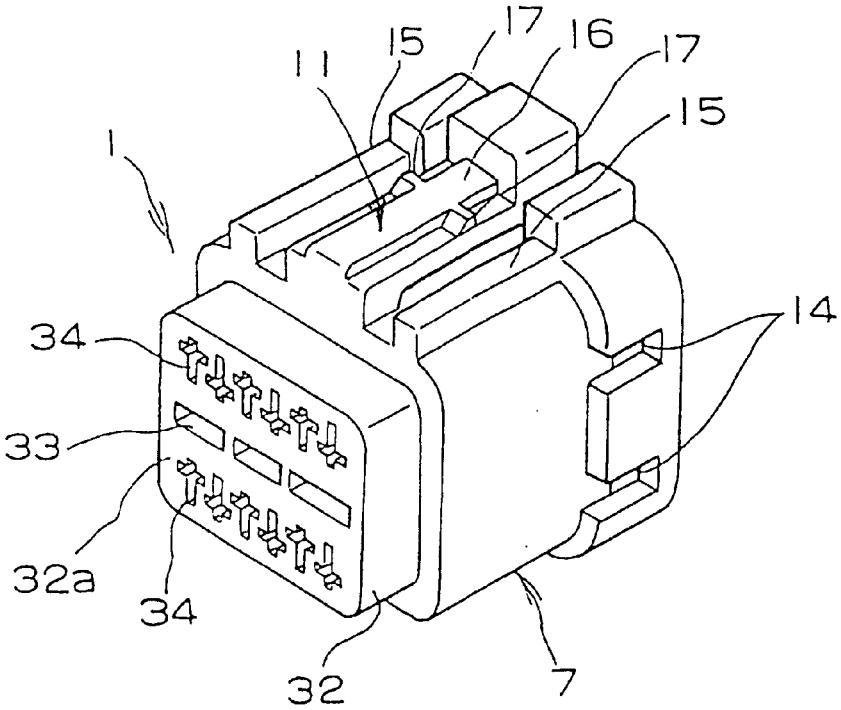
FIG. 3 is a perspective view of a connector body of a plug connector for the multipole waterproof connector.
Figure 4:
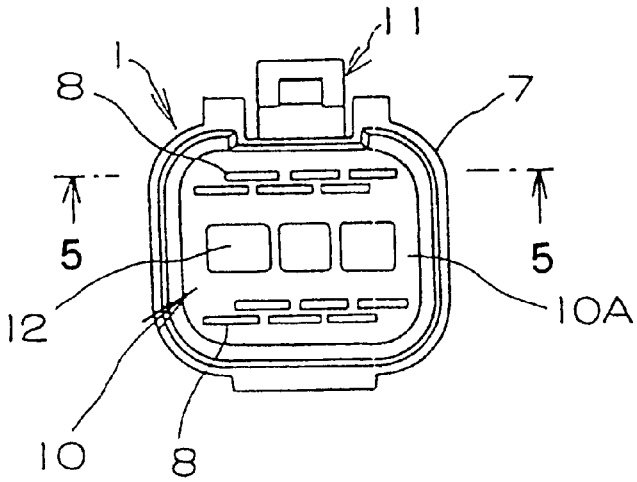
FIG. 4 is a rear elevational view of the connector body.
Figure 5:
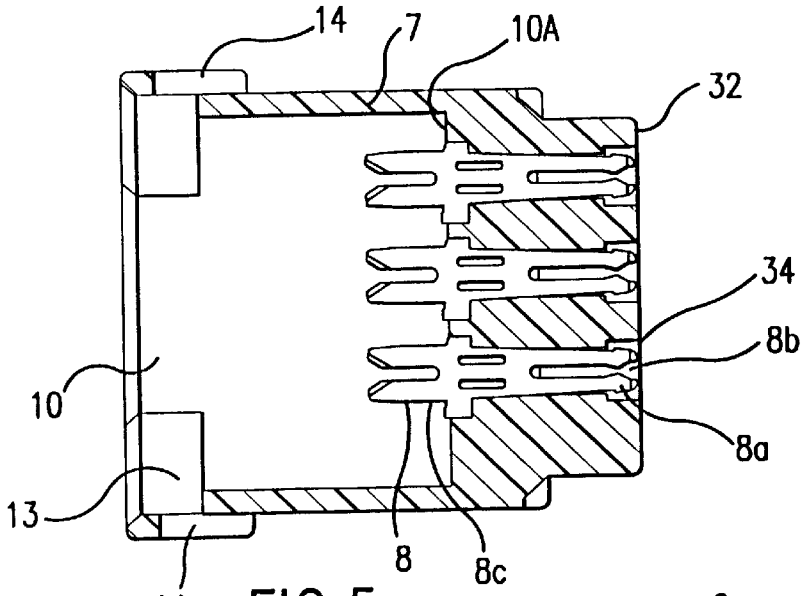
FIG. 5 is a sectional view taken along line 5—5 of FIG. 4.
Figure 6:
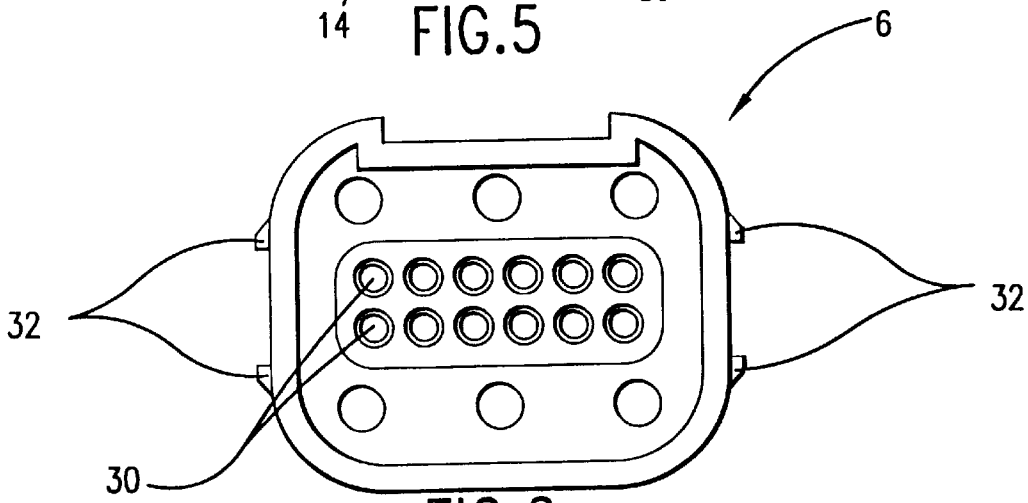
FIG. 6 is a rear elevational view of a insertion-block of the plug connector.
Figure 7:
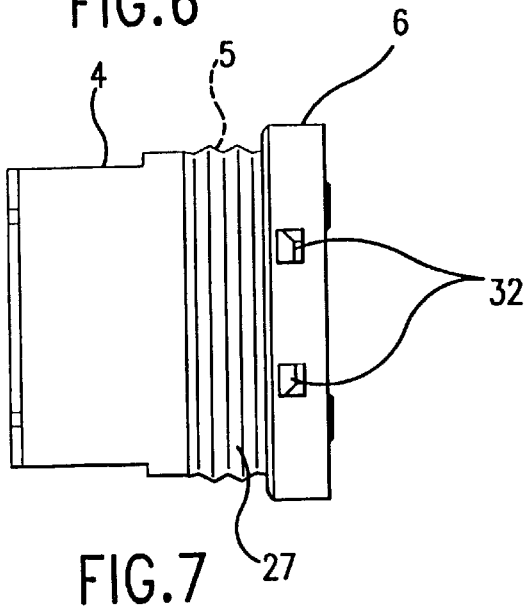
FIG. 7 is a side elevational view of the insertion-block.

In FIGS. 3–5, the connector housing 7 has a plugging projection 32 at the front end and a fitting recess 10 at the rear end and a lock section 11 on the top surface. Three recesses 33 extend rearwardly from the front face 32*a* of the plugging projection 32, and 12 mating terminal insertion slots 34 extend rearwardly from the front face 32*a* and are arranged laterally in two rows above and below the three recesses 33 at regular intervals. Three projections 12 extend rearwardly from the end face 10A of the fitting recess 10 and are arranged laterally at the center line.

12 press-fit (insulation-displacement) terminals 8 are provided on the end face 10A in a zigzag fashion in two rows above and below the three projections 12. As best shown in FIG. 5, the press-fit (insulation-displacement) sections 8*c* of the press-fit (insulation-displacement) terminals 8 extend into the fitting recess 10. The bifurcated contact points 8*a* of the press-fit terminals 8 extend into the plugging projection 32 such that the throat portions 8*b* of the contact points 8*a* align with the mating terminal insertion slots 34. A pair of retainer receiving sections 13 are provided at the opening of the fitting recess 10. A pair of engaging holes 14 are provided on the walls of the retainer receiving sections 13. The lock section 11 comprises a pair of guiding ridges 15, a cantilevered lock lever 16 disposed between them, and a pair of lock projections 17 extending laterally from the lock lever 16.

Figure 8:
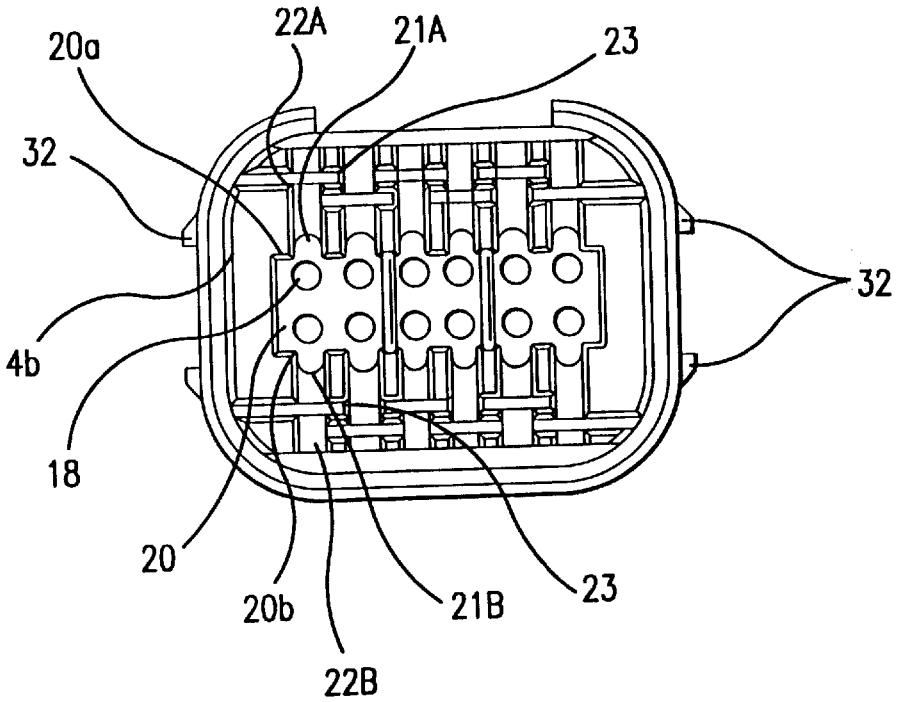
FIG. 8 is a front elevational view of the insertion-block.
Figure 9:
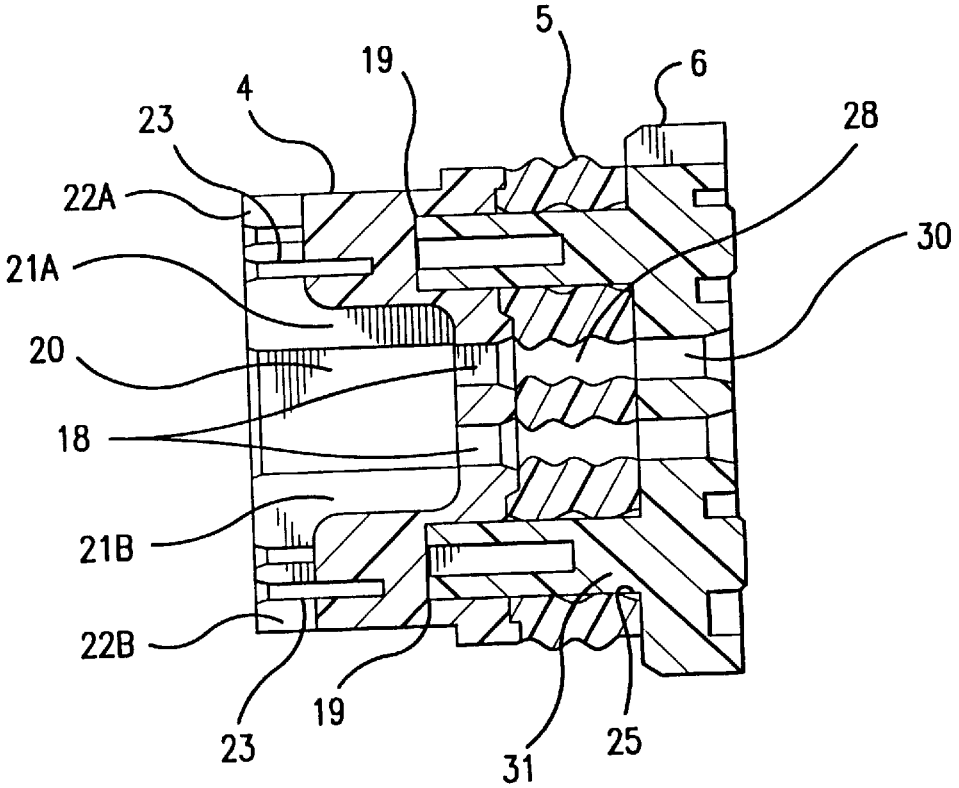
FIG. 9 is a sectional view of the insertion-block.
Figure 10:
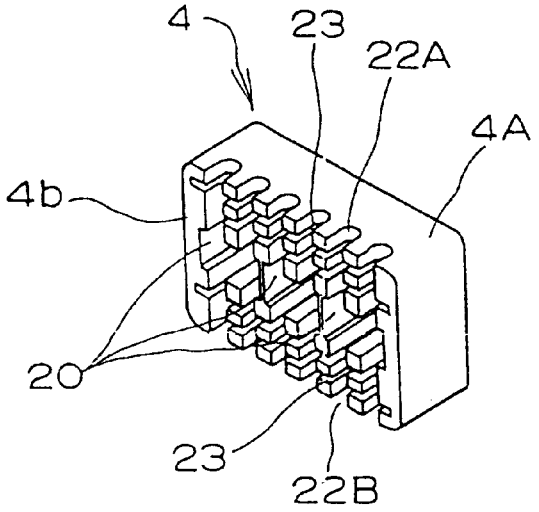
FIG. 10(1) is a perspective view of an organizing protector for the insertion-block.
Figure 10:
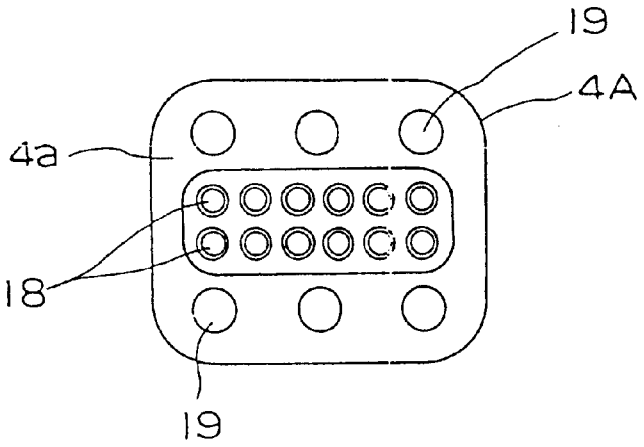

As best shown in FIGS. 8 and 10(1)–(2), the organizing protector 4 has a rectangular protector body 4A. 12 cable insertion apertures 18 are provided in the rear face 4*a* of the protector body 4A in two rows with a constant pitch. Six spacer fitting recesses 19 are provided on the rear face 4*a* in two rows above and below the cable insertion apertures 18. Three recesses 20 are provided on the front face 4*b* of the protective body 4A at the center line with a predetermined interval. Four cable insertion apertures 18 are provided for each of the three recesses 20. A pair of groups of six longitudinal cable insertion slots 21A and 21B are provided in the upper and lower faces 20*a* and 20*b* of the recesses 20, respectively, corresponding to the cable insertion apertures 18.

A pair of groups of six lateral cable insertion slots 22A and 22B are provided in the front face 4*b* of the protective body 4A at upper and lower positions, respectively, communicating with the longitudinal cable insertion apertures 21A and 22B, respectively. Press-fit terminals insertion slots 23 are provided in the front face 4*b* of the protector body 4A so as to traverse the upper and lower lateral cable insertion slots 22A and 22B.

Figure 13:
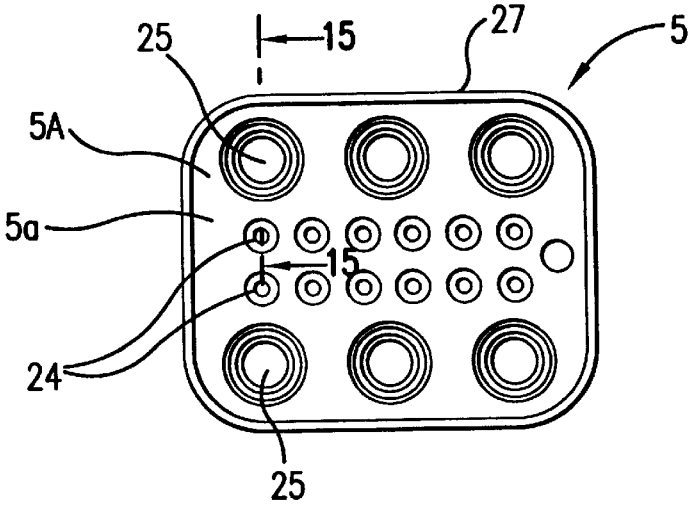
FIG. 13 is a front elevational view of a multihole wire seal for the insertion-block.
Figure 14:
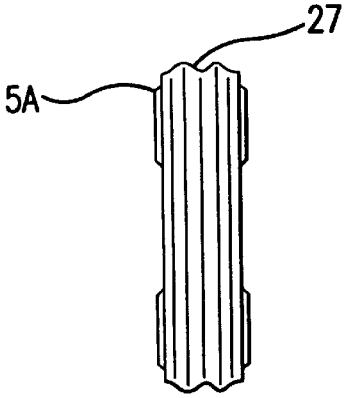
FIG. 14 is a side elevational view of the multihole wire seal.
Figure 15:
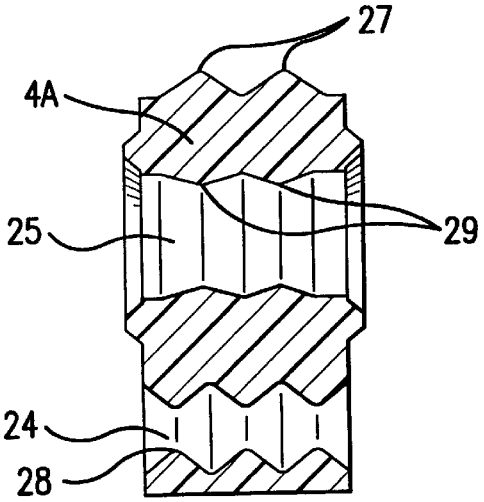
FIG. 15 is a sectional view taken along line 15—15 of FIG. 13.

As best shown in FIGS. 13–15, the multihole wire seal 5 has a rectangular seal body 5A made from silicon rubber. 12 cable insertion apertures 24 are provided in the face 5*a* of the seal body 5 in two rows. Six spacer fitting holes 25 are provided in the face 5*a* in two rows above and below the cable insertion apertures 24, respectively. A plurality of lip portions 27 are provided at the periphery of the seal body 5A. A plurality of lip portions 28 and 29 are provided at the inside of the cable insertion apertures 24 and the spacer fitting holes 25, respectively, to provide waterproof for gaps between the cables 3 and the connector housing 7.

Figure 11:
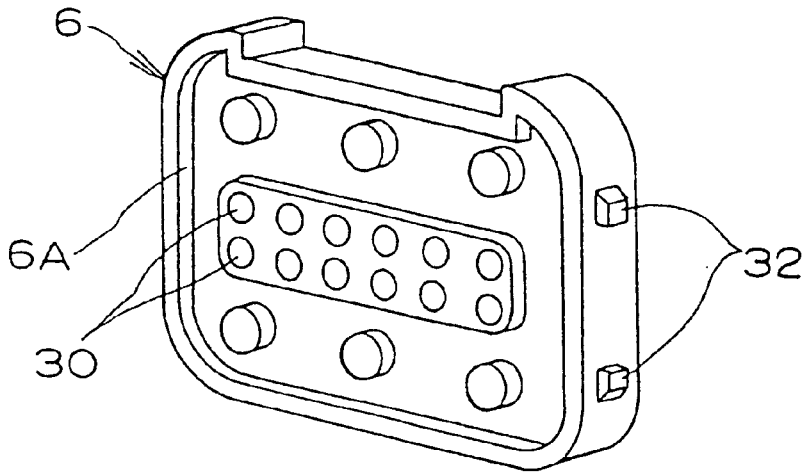
FIG. 11 is a rear perspective view of a retainer for the insertion-block.
Figure 12:
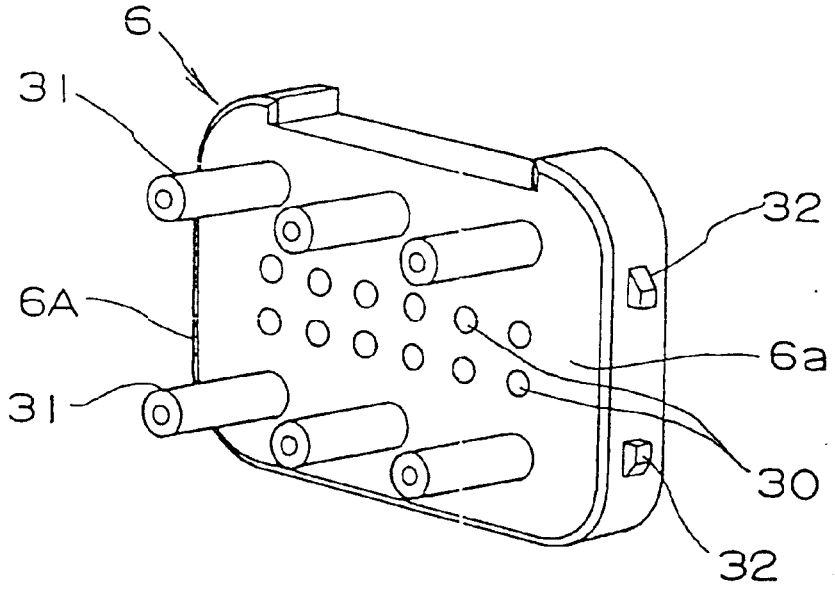
FIG. 12 is a front perspective view of the retainer.

As best shown in FIGS. 11 and 12, the retainer 6 has a rectangular retainer body 6A. 12 cable insertion apertures 30 are provided in the face 6*a* of the retainer 6 in two rows. Six spacers 31 extend forwardly from the face 6*a* in two rows above and below the cable insertion apertures 30. A plurality of engaging projections 32 are provided on left and right side faces of the retainer body 6A to prevent the multihole wire seal 5 from deforming under an external force upon the cable 3.

The multihole wire seal 5 is provided between the organizing protector 4 and the retainer 6 such that the spacers 31 of the retainer 6 enter the spacer fitting holes 25 of the multihole wire seal and the ends of the spacers 31 fit in the spacer fitting recesses 19 of the organizing protector 4 to thereby form the insertion-block 2. The multihole wire seal 5 is pressed between the organizing protector 4 and the retainer 6 so that it expand in the direction perpendicular to the compression direction. Consequently, the lip portions 27 of the seal body 5A project outwardly, and the lip portions 28 and 29 of the cable insertion apertures 24 and the spacer fitting apertures 25 project inwardly. The organizing protector 4 and the retainer 6 may be molded integrally. In this case, there is provided a separate seal between the multihole wire seal 5 and the connector housing 7. The organizing protector 4, the retainer 6, and the multihole wire seal 5 may be molded integrally.

FIGS. 2(1)–(6) show how 12 cables 3 are connected to the insertion-block 2. As best shown in FIGS. 2(1)–(2), 12 cables 3 are inserted into cable insertion apertures 18 of the organizing protector 4 via the cable insertion apertures 24 of the multihole wire seal 5 and the cable insertion apertures 30 of the retainer 6, and the cables 3 are inserted into the longitudinal cable insertion slots 21A and 21B such that the end portions 3*a* of the cables 3 project from the organizing protector 4. Then, as shown in FIG. 2(3), the end portions 3*a* of the cables 3 are bent into the lateral cable insertion slots 22A and 22B and, as shown in FIG. 2(4), the excessive end portions 3*b* are cut off.

Then, as shown in FIG. 2(5), the insertion-block 2 is press-fitted into the fitting recess 10 of the connector body 1 such that the press-fit portions 8*c* of the press-fit terminals 8 are inserted into insertion slots 23 and press-fitted to the cables 3 to connect the cables 3 to the press-fit terminals 8 while the retainer 6 is inserted into the insertion section 13 of the connector housing 1 such that the engaging projection 32 of the retainer 6 engage the engaging holes 14 of the retainer insertion section 13 to thereby form a plug connector A.

The lip portions 27 of the seal body 5A are pressed against the fitting recess 10 of the connector housing 1 while the lop portions 28 of the cable insertion apertures 24 are pressed against the cables 3, and the lip portions 29 of the spacer fitting apertures 25 are pressed against the spacer 31 to thereby provide waterproof.

A plurality of projections 12 are provided on the end face of the connector housing 7 and a plurality of recesses 20 are provided in the front face 4*b* of the protector body 4A. A plurality of cable insertion apertures 18 are provided in the bottom of the recesses 20 and a plurality of longitudinal cable insertion slots 21A and 21B are provided upper and lower faces 20*a* and 20*b* of the recesses 20. The longitudinal cable insertion slots 21A and 21B are communicated with the lateral cable insertion slots 22A and 22B such that the cables 3 in the cable insertion apertures 18 are inserted into the longitudinal cable insertion slots 21A and 21B. The end portions 3*a* of the cables 3 projecting from the organizing protector 4 are bent into the lateral cable insertion slots 22A and 22B so that when the insertion-block 2 is press-fitted into the connector housing 7, the projections 12 of the connector housing 7 are inserted into the recesses 20 to hold the cables 3 in the recesses 20 thereby increasing the pulling resistance of the cables 3.

Figure 16:
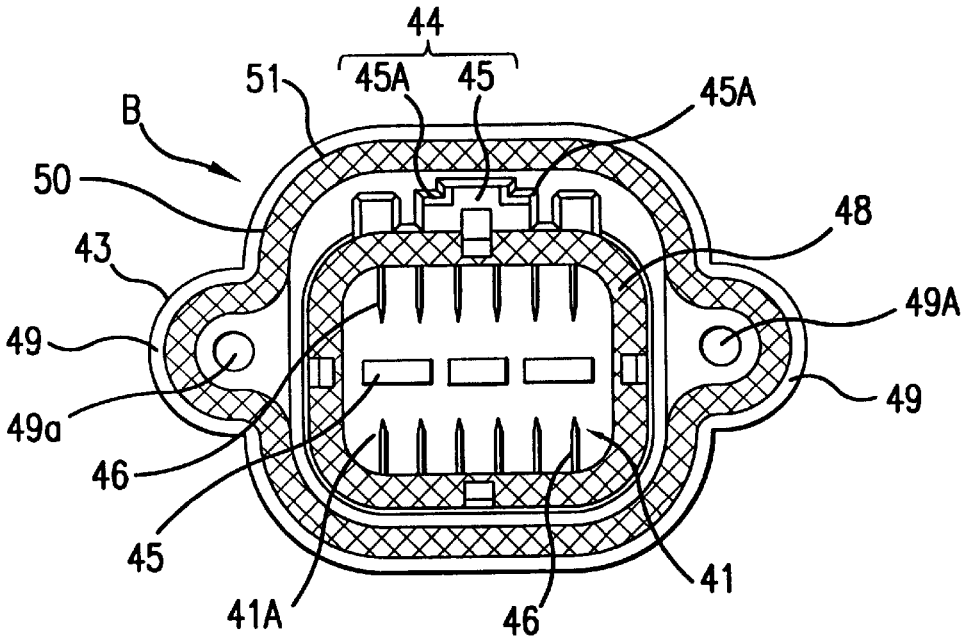
FIG. 16 is a front elevational view of a receptacle connector for the multipole waterproof connector.
Figure 17:
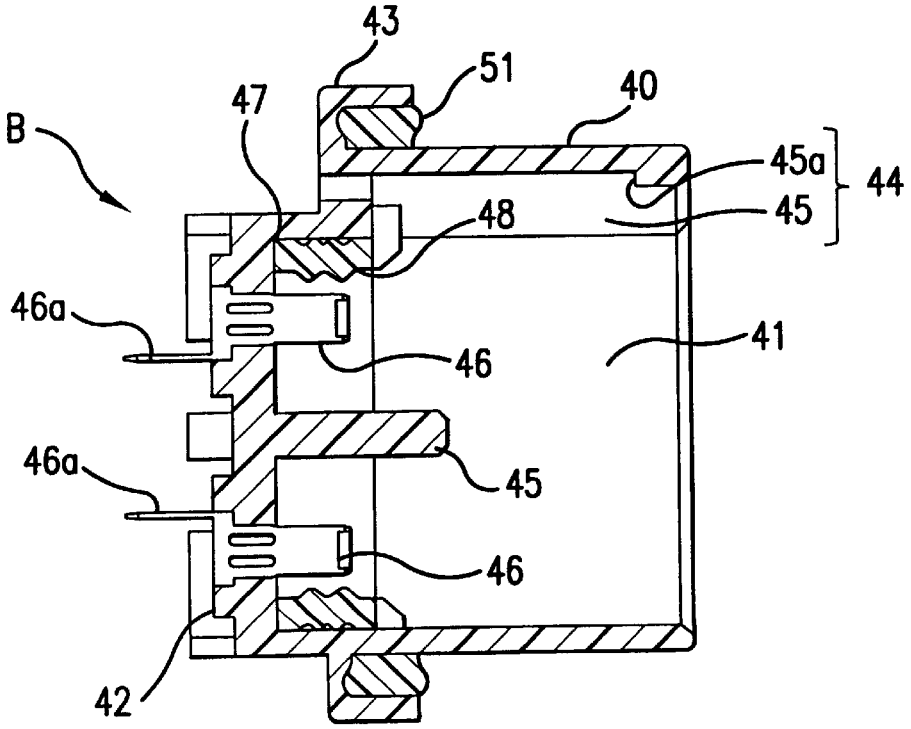
FIG. 17 is a sectional view of the receptacle connector.
Figure 18:
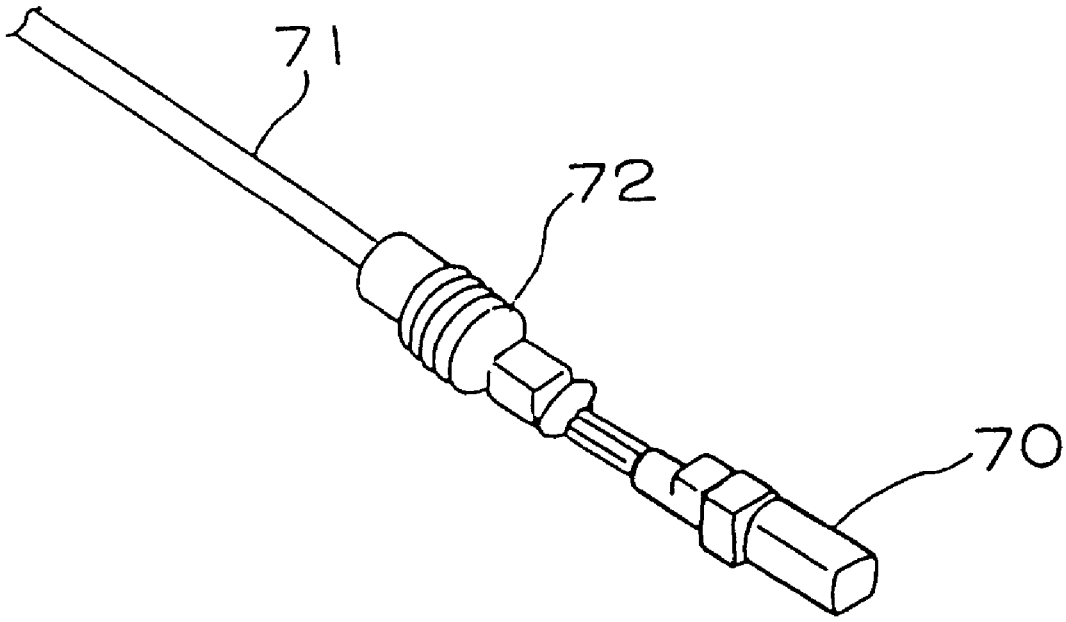
FIG. 18 PRIOR ART
FIG. 18 is a perspective view of a cable for a conventional multipole waterproof connector.

As shown in FIGS. 16 and 17, the receptacle connector B has a connector housing 40 which has a plugging recess 41 at the front end and a mounting section 42 at the rear end. A attaching flange 43 is provided at the periphery of the connector housing 40. A lock section 44 is provided at the upper wall 41*a* of the plugging recess 41 and comprises a locking groove 45 and a pair of engaging projections 45A. Three projections 45 are provided on the end face 41A of the plugging recess 41 and a plurality of tab terminals (contact terminals) 46 are provided at upper and lower positions of the projections 45. The leads 46*a* of the tab terminals 46 project from the board mounting section 42. A seal attaching portion 47 is provided at the periphery of the end face 41A for receiving an annular seal member 48.

A pair of attaching sections 49 with attaching holes 49*a* are provided in the attaching flange 43. A continuous seal groove 50 is provided in the attaching flange 43 for receiving a seal member (panel seal) 51. The receptacle connector B is mounted on a printed circuit board 52 by inserting and soldering the leads 46*a* to the through-hole 53 and the seal member (panel seal) 51 is pressed against the front panel 55 of a equipment case 54.

By plugging the plugging section 32 of the plug connector A into the plugging recess 41 of the receptacle connector B, the tab terminals 46 of the receptacle connector B are inserted into the mating terminal insertion slots 34 of the plugging section 32 to bring them into contact with the contact points 8*a* of the press-fit terminals 8 while the lock lever 16 of the plug connector A is inserted into the lock groove 45 of the receptacle connector 13 to engage the lock projections 17 with the engaging projections 45A for making lock. Thus, the plugging section 32 of the plug connector A is brought into contact with the seal member 48 for making seal.

A plurality of cables 3 are connected to the insertion-block 2 and the press-fit block 2 is fitted into the connector housing 7 such that the press-fit portions 8*c* of the press-fit terminals 8 are press-fitted to the cables 3 to provide a multipole waterproof connector, thereby making not only en-bloc but also automatic connection of the cables 3 possible. The multihole wire seal 5 is provided between the organizing protector 4 and the retainer 6 such that the spacers 31 are inserted into the spacer fitting holes 25 of the multihole wire seal 5 to fit the ends of the spacers 31 into the spacer fitting recesses 19, thereby improving assembling of the insertion-block 2 and the connection of the cables 3.

According to the invention, a plurality of cables are attached to the press-fit block, and the insertion-block is fitted into the connector housing such that the press-fit portions of the press-fit terminals are press-fitted to the cables to thereby make a compact multipole waterproof connector, making possible not only en-bloc connection of the cables but also automated connection of the cables, thus reducing amounts of labor.

The wire seal is provided between the organizing protector and the retainer such that the spacers are fitted in the fitting holes of the wire seal and the ends of the spacers are fitted into the recesses of the organizing protector to make the insertion-block so that it is easy to assemble the press-fit block and connect the cables to the connector. The wire seal is held between the organizing protector and the retainer such that the lip portions of the wire seal are pressed against the inside wall of the connector housing and the lip portions of the cable insertion apertures are pressed against the cables, and lip portions of the spacer fitting holes are pressed against the spacers, thereby improving the waterproof property.

A plurality of projections are provided on the end face of the fitting recess in the connector housing and a plurality of recesses are provided in the protector body, and a plurality of cable insertion apertures in the bottom of the recess and a plurality of longitudinal cable insertion slots are provided on the side wall of the recess such that the cable insertion slots are communicated with the lateral cable insertion slots of the protector body, the cables in the cable insertion apertures are inserted into the longitudinal cable insertion slots, and the ends of the cables are bent into the lateral cable insertion slots. When the insertion-block is fitted into the connector housing, the projections of the connector housing enter the recesses to hold the cables in the recesses so that the pulling resistance of the cables are enhanced.

What is claimed is:

1. A multipole waterproof connector comprising:

a connector housing having a plugging projection and a fitting recess;

at least one insulation-displacement terminal attached to said connector housing such that a contact point and a insulation-displacement portion of said insulation-displacement terminal are on both sides of said plugging projection and said fitting recess, respectively; a discrete insertion-block having a discrete elastic wire seal around at least one cable insertion aperture;

at least one cable put through said cable insertion aperture and bent at an end into said press-fit block;

said press-fit block being fitted into said connector housing such that said insulation-displacement portion of said insulation-displacement terminal is press-fitted to said cable for connection by insulation displacement.

2. A multipole waterproof connector comprising:

a connector housing having a plugging projection and a fitting recess on opposite sides thereof;

at least one insulation-displacement terminal such that a contact point and a insulation-displacement portion of said insulation-displacement terminal are on both sides of said plugging projection and said fitting recess, respectively;

a discrete insertion-block consisting of an organizing protector having at least one cable insertion slot, a discrete elastic wire seal, and retainer provided in this order such that cable insertion apertures of said organizing protector, said wire seal, and said retainer communicate with each other;

at least one cable put through said cable insertion apertures and bent at one end into said cable insertion slot of said organizing protector;

said insertion-block being fit into said connector housing such that said insulation-displacement portion of said insulation-displacement terminal is press-fitted to said cable for connection by insulation displacement.

3. A multipole waterproof connector according to claim 2, wherein said retainer has at least one spacer and said wire seal has at least one spacer fitting hole, and said organizing protector has a spacer fitting recess such that an end of said spacer is fitted in said spacer fitting recess through said spacer fitting hole.

4. A multipole waterproof connector according to claim 3, wherein said wire seal has at least one lip portion at a side wall, at least one lip portion around said cable insertion aperture, and at least one lip portion around said spacer fitting hole such that when said wire seal is held between said organizing protector and said retainer, said lip portions are pressed against an inside wall of said connector housing, said cable, and said spacer, respectively.

5. A multipole waterproof connector according to claim 3, wherein said connector housing has at least one projection provided on a bottom of said fitting recess and said organizing protector has at least one recess through which said cable insertion aperture extends, at least one longitudinal cable insertion slot on a side of said recess and at least lateral cable insertion slot on said organizing protector communicating with said longitudinal cable insertion slot such that said cable in said cable insertion aperture is inserted into said longitudinal cable insertion slot and bent into said lateral cable insertion slot and, when said insertion-block is fitted into said connector housing, said projection enters said recess to hold said cable in said recess.

* * * * *